United States Patent [19]

Tsunemi et al.

[11] Patent Number: 4,504,403

[45] Date of Patent: Mar. 12, 1985

[54] REFRIGERATION OIL COMPOSITION

[75] Inventors: Masaaki Tsunemi, Yokohama; Umekichi Sasaki, Kawasaki, both of Japan

[73] Assignee: Nippon Oil Co., Ltd., Tokyo, Japan

[21] Appl. No.: 606,854

[22] Filed: May 3, 1984

Related U.S. Application Data

[63] Continuation of Ser. No. 369,901, Apr. 19, 1982, abandoned.

[30] Foreign Application Priority Data

Apr. 23, 1981 [JP] Japan ..... 56-61655

[51] Int. Cl.[3] ..... C10M 1/16

[52] U.S. Cl. ..... 252/68; 252/49.6; 252/49.9; 252/52 A; 252/56 R

[58] Field of Search ..... 252/49.6, 68, 52 R, 252/70, 56 R, 49.9; 585/25

[56] References Cited

U.S. PATENT DOCUMENTS 2,526,896 10/1950 Ipatieff et al. ..... 585/25
3,642,634 2/1972 Olund ..... 252/68
3,856,740 12/1974 Takahashi et al. ..... 585/25
4,199,461 4/1980 Olund ..... 252/68
4,248,726 2/1981 Uchinama et al. ..... 252/68

*Primary Examiner*—Jacqueline V. Howard
*Attorney, Agent, or Firm*—Bucknam and Archer

[57] ABSTRACT

A refrigeration oil composition conforming to this invention essentially comprises a bicyclic compound of the formula

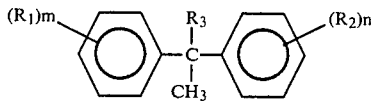

where $R_1$ and $R_2$ may be the same or different and each are an alkyl group of 1~5 carbon atoms; $R_3$ is hydrogen or an alkyl group of 1~5 carbon atoms; and m and n may be the same or different and each are 0 or an integer of 1~5, said bicyclic compound having a dynamic viscosity of 5~20 cSt at 40° C. The composition may further incorporate various additives useful for inhibiting wear, oxidation, foaming and the like.

1 Claim, No Drawings

REFRIGERATION OIL COMPOSITION

This application is a continuation of application Ser. No. 369,901, filed Apr. 19, 1982, now abandoned.

BACKGROUND OF THE INVENTION

1. Field of the Invention

This invention relates to refrigeration oil compositions for use in refrigeration apparatus.

2. Prior Art

Generally, the rate of electric power consumption assumed by refrigeration apparatus is considerably high and is currently reported to be roughly 20% in the case of home-use refrigerators against total household power consumption. Efforts have been paid to reduce the rate of power consumed by refrigerators, such efforts being directed to reducing the viscosity of lubricating oils. However, the use of less viscous lubricants world often result in discontinued oil film at the portions of the compressor to be lubricated and also in reduced wear resistance, shortening the normal safety service life of the equipment. Another problem is that conventional low viscosity lubricants would entail undue operating troubles where the refrigeration oil is used in the presence of halogenated refrigerants.

SUMMARY OF THE INVENTION

With the foregoing difficulties of the prior art in view, the present invention is aimed at the provision of a refrigeration oil composition which is useful in effectively reducing power consumption by refrigeration apparatus.

The refrigeration oil composition according to the invention essentially comprises a bicyclic compound of the formula

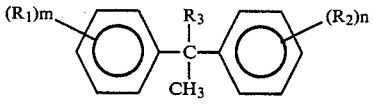

where $R_1$ and $R_2$ may be the same or different and each are an alkyl group of $1\sim5$ carbon atoms; $R_3$ is hydrogen or an alkyl group of $1\sim5$ carbon atoms; and m and n may be the same or different and each are 0 or an integer of $1\sim5$, said bicyclic compound having a dynamic viscosity of $5\sim20$ cSt at 40° C.

The refrigeration oil composition of the invention may further contain at least one of additives of the group consisting of hydrochloric acid capturing agents, wear inhibitors, oxidation inhibitors and defoaming agents in an amount of 1 ppm $\sim$10.0 percent by weight based on the total amount of the composition.

DETAILED DESCRIPTION OF THE PREFERRED EMBODIMENT

The bicyclic compound which constitutes the principal component of the inventive composition is represented by the general formula

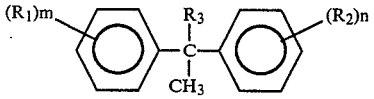

where $R_1$ and $R_2$ may be the same or different and each are an alkyl group of $C_1\sim C_5$, preferably $C_1\sim C_2$; $R_3$ is hydrogen or an alkyl groups of $C_1\sim C_5$, preferably hydrogen or a methyl group; and m and n may be the same of different and each are 0 or an integer of $1\sim5$, preferably an integer of $1\sim2$, respectively.

The above formulated compound may result from the reaction between an aromatic vinyl compound predominant of styrene or $\alpha$-methylstyrene and an alkyl aromatic compound predominant of toluene or xylene. The method of preparing such compounds is disclosed for example in Japanese Laid-Open Patent Publication Nos. 47-29351 and 53-135959.

The hydrochloric acid capturing agent used in the invention may be a glycidylether epoxy compound, an epoxized aliphatic acid monoester, an epoxized vegetable oil and a tri-substituted-phosphorous acid ester, amongst which the glycidylether epoxy compound, particularly phenyl glycidylether is most preferred. Some of these compounds are disclosed in Japanese Laid-Open Patent Publication No. 55-58298. These capturing agents may be added in an amount of $0.01\sim10.0$, preferably $0.1\sim5.0$ weight percent based on the total amount of the composition.

The wear inhibitor used herein is a tri-substituted-phophoric acid ester including trialkyl phosphoric acid ester such as trioleyl phosphate, triaryl phosphoric acid ester such as triphenyl phosphate, and trialkaryl phosphoric acid such as tricresyl phosphate, of which trialkaryl phosphoric acid is most preferred. This wear inhibitor may be used in an amount of $0.01\sim10.0$, preferably $0.1\sim5.0$ weight percent based on the total amount of the composition.

The oxidation inhibitor according to the invention is an alkylphenol and/or an aromatic amine. The alkylphenol may be represented by the general formula

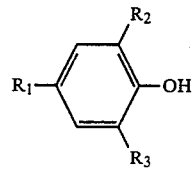

where $R_1\sim R_3$ may be the same or different and each are an alkyl group of $C_1\sim C_4$, or

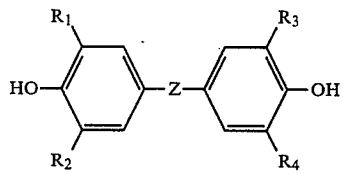

where $R_1\sim R_4$ may be the same or different and each are an alkyl group of $C_1\sim C_4$; and Z is a divalent group such as $$-(CH_2)_n-$$

(n=0$\sim$4), —S—, —S—S—, and —$CH_2$—S—$CH_2$, or

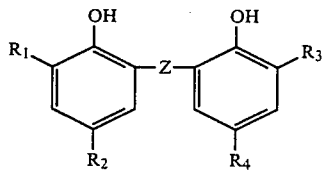

where $R_1 \sim R_4$ may be the same or different and each are an alkyl group of $C_1 \sim C_4$; and Z is a divalent group such as $$\text{—}(CH_2)_n\text{—}$$

(n=0~4), —S—, —S—S—, and —$CH_2$—S—$CH_2$—.

Typical examples of the above formulated compounds include 2,6-di-t-butyl-p-cresol, 4,4'-methylenebis(2,6-di-t-butyl phenol), 4,4'-dihydroxy-3,3',5,5'-tetra-t-butyl bisphenol, 4,4'-thiobis(2,6-di-t-butyl phenol), bis(3,5-di-t-butyl-4-hydroxy benzyl)sulfide, and 2,2'-methylenebis(4-methyl-6-t-butyl phenol), of which 4,4'-methylenebis(2,6-di-t-butyl phenol) and 2,6-di-t-, butyl-p-cresol are most preferred.

The aromatic amine may be represented by the formula $$R_1\text{—NH—}R_2$$

where $R_1$ and $R_2$ may be the same or different and each are an aryl or alkaryl group of $C_6 \sim C_{18}$, or

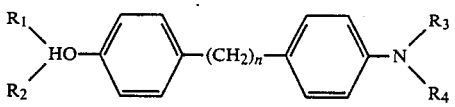

where $R_1 \sim R_4$ may be the same or different and each are an alkyl group of $C_1 \sim C_4$ and n is an integer of 1~4.

Typical examples of the above formulated compounds include dihexyl amine, phenyl-α-naphthyl amine, phenyl-β-naphthyl amine, phenyl-p-octyl phenyl amine, p,p'-dioctyldiphenyl amine, 2,6-di-t-butyl-α-dimethylamino-p-cresol and tetramethyl-diamino diphenyl methane, of which phenyl-α-naphthyl amine and diphenyl amine are most preferred. The oxidation inhibitor of the class defined may be added in amount of 0.01~10.0, preferably 0.05~2.0 weight percent based on the total amount of the composition.

The defoaming agent as used in the invention is a dimethyl silicone oil which may be added in an amount of 1~1,000 ppm based on the total amount of the composition.

The invention will be further described by way of the following examples.

TABLE 1

| | Inventive Oil Composition | | |
|---|---|---|---|
| | Inventive Example 1 | Inventive Example 2 | Inventive Example 3 |
| Bicyclic compound | SAS-296 (100 wt. %) | SAS-296 (99.5 wt. %) | SAS-296 (98.3 wt. %) |
| Hydrochloric acid capture agent | — | P G E (0.5 wt. %) | P G E (0.5 wt. %) |
| Wear inhibitor | — | — | T P P (1.0 wt. %) |
| Oxidation inhibitor | — | — | D B P C (0.2 wt. %) |
| Defoaming agent | — | — | D M S O (10 ppm) |
| Dynamic viscosity (cSt, 40° C.) | 5.0 | 5.0 | 5.0 |

Note:
Bicyclic Compound: SAS-296 (dynamic viscosity - 5 cSt at 40° C.) manufactured by Nippon Petrochemicals Company Ltd.
Additives:
P G E . . . Phenyl glycidylether
T P P . . . Triphenyl phosphate
D B P C . . . 2,6-di-t-butyl-p-cresol
D M S O . . . dimethyl silicone oil Comparative Oil (1) Naphthenic oil: Dynamic viscosity—30 cSt at 40° C.

(2) Paraffinic oil: Dynamic viscosity—14 cSt at 40° C.

Samples of each of the above listed refrigeration oils were tested with the results shown in Table 2 below.

TABLE 2

| | | Test Data | | | | |
|---|---|---|---|---|---|---|
| | | Inventive Example | | | Comparative Oil | |
| Tests | Method | 1 | 2 | 3 | (1) | 2) |
| Wear (mg) | *1Falex (ASTM D-323373) | 109 | 105 | 55 | 70 | 50 |
| Bake load (lb) | *1Falex (ASTM D-323373) | 635 | 630 | 750 | 580 | 560 |
| Discoloration | *2Sealed tube | 1 | 0 | 0 | above 8 | [illegible] |
| Copper plating | *2Sealed tube | only trace | none | none | all over | all over |
| *3Power saving effect (%) | — | 95 | 93 | 93 | 100 | 97 |

*1Falex test ASTM D-323373: A test piece conforming to this regulation was run initially under a load of 25 lb for 5 minutes and then under a load 375 lb for 3 hours. The test piece was measured for the difference in weight before and after the test run thereby determining the amount of wear or friction loss.

*2Sealed tube test: An equivalent mixture of each of the test oils and a refrigerant (R-12) was charged together with a copper-iron catalyst into and sealed in a glass tube and heated at 175° C. for 480 hours, whereupon change in color of the oil was observed. Discoloration of the order of less than 4 is acceptable where 0 is colorless and 8 is dark brown. Copper plating on the catalyst was also observed.

*3Power saving effect in refrigerator operation was determined from the rate of actual power consumption taking Comparative Oil (1) as a basis of comparison.

What is claimed is:

1. The method of lowering the power requirements of a refrigeration system which comprises a refrigerant and a refrigeration oil, which consists of adding to said refrigerant a composition consisting of a compound of the formula:

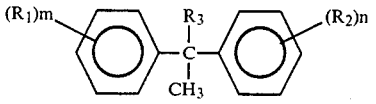

wherein $R_1$ and $R_2$ are the same or different and each are an alkyl group of 1 to 5 carbon atoms; $R_3$ is hydrogen or an alkyl group of 1 to 5 carbon atoms; m and n are the same or different and each are 0 or an integer of 1 to 5, said compound having a dynamic viscosity of 5 to 20 cSt at 40° C. and at least one additive which is a member selected from the group consisting of:

(a) a hydrocholoric acid capturing agent, which is a member selected from the group consisting of glycidylether epoxy compounds, epoxized aliphatic acid monoesters, epoxized vegetable oils and tri-substituted-phosphorous acid esters;

(b) a wear inhibitor, which is a tri-substituted-phosphoric acid ester;

(c) an oxidation inhibitor, which is an alkylphenol or an aromatic amine or a mixture thereof; and (d) a defoaming agent which is a dimethyl silicone oil in an amount of 1 ppm to 10.0 percent by weight based on the total amount of the composition.

* * * * *